US006871429B2

(12) United States Patent
Shea

(10) Patent No.: US 6,871,429 B2
(45) Date of Patent: Mar. 29, 2005

(54) GREETING CARD HAVING A REMOVABLE STICKER

(76) Inventor: Timothy F. Shea, 412 Springlake Blvd. #102, Granger, IN (US) 46530

( * ) Notice: Subject to any disclaimer, the term of this patent is extended or adjusted under 35 U.S.C. 154(b) by 1 day.

(21) Appl. No.: 10/281,594

(22) Filed: Oct. 28, 2002

(65) Prior Publication Data

US 2004/0079006 A1 Apr. 29, 2004

(51) Int. Cl.[7] ..... G09F 1/00

(52) U.S. Cl. ..... 40/124.09; 40/124.11; 40/124.12; 40/638

(58) Field of Search ..... 40/124.01, 124.09, 40/124.11, 124.12, 124.13, 638, 594; 283/117, 81

(56) References Cited

U.S. PATENT DOCUMENTS

| | | | | |
|---|---|---|---|---|
| 2,363,472 A | | 11/1944 | Ritter | |
| 2,805,816 A | | 9/1957 | Morgan | |
| 4,024,656 A | | 5/1977 | Farnsworth | |
| 4,200,222 A | | 4/1980 | Feuer | |
| 4,439,941 A | | 4/1984 | Halperin | |
| 5,102,171 A | | 4/1992 | Saetre | |
| 5,219,184 A | | 6/1993 | Wolf | |
| 5,261,703 A | | 11/1993 | Lenkoff | |
| 5,269,084 A | | 12/1993 | Best et al. | |
| 5,284,365 A | | 2/1994 | Stuart | |
| 5,303,487 A | | 4/1994 | Olson | |
| 5,318,327 A | | 6/1994 | Daneshvar | |
| 5,490,739 A | | 2/1996 | Olson | |
| 5,551,730 A | | 9/1996 | Barreca et al. | |
| 5,667,248 A | | 9/1997 | Mayer | |
| 5,822,897 A | | 10/1998 | Ertzan | |
| 5,829,790 A | | 11/1998 | Phillips | |
| 6,035,565 A | * | 3/2000 | Capehart | 40/594 |
| 6,230,425 B1 | | 5/2001 | Ellison | |
| 6,311,418 B1 | | 11/2001 | Crowell | |
| 6,481,125 B1 | * | 11/2002 | Pokrasoff | 40/124.01 |
| 2001/0027617 A1 | * | 10/2001 | McGuiness | 40/124.11 |

* cited by examiner

*Primary Examiner*—Gary C. Hoge
(74) *Attorney, Agent, or Firm*—Barnes & Thornburg LLP

(57) ABSTRACT

A greeting card has a substrate and a sticker removably attached to the substrate.

22 Claims, 5 Drawing Sheets

GREETING CARD HAVING A REMOVABLE STICKER

BACKGROUND AND SUMMARY

The present disclosure relates to greeting cards and stickers.

Additional features of the disclosure will become apparent to those skilled in the art upon consideration of the following detailed description of illustrative embodiments exemplifying the best mode as presently perceived.

BRIEF DESCRIPTION OF THE DRAWINGS

The detailed description particularly refers to the accompanying figures in which.

DETAILED DESCRIPTION OF THE DRAWINGS

Figure 1:
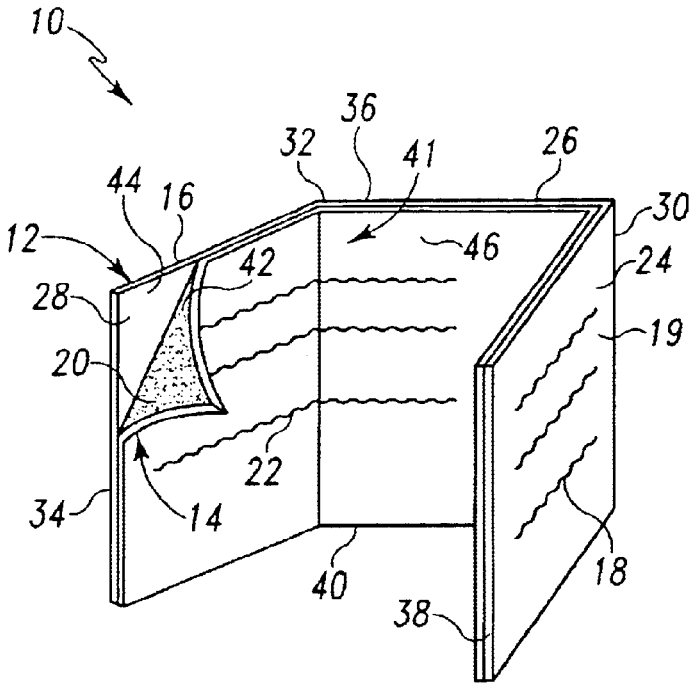
FIG. 1 is a perspective view of a greeting card having a substrate and a sticker adhesively and removably attached to the substrate, the greeting card having three panels interconnected by a pair of creases for folding the greeting card in thirds, and the sticker being configured to extend to the edges of the substrate.
Figure 2:
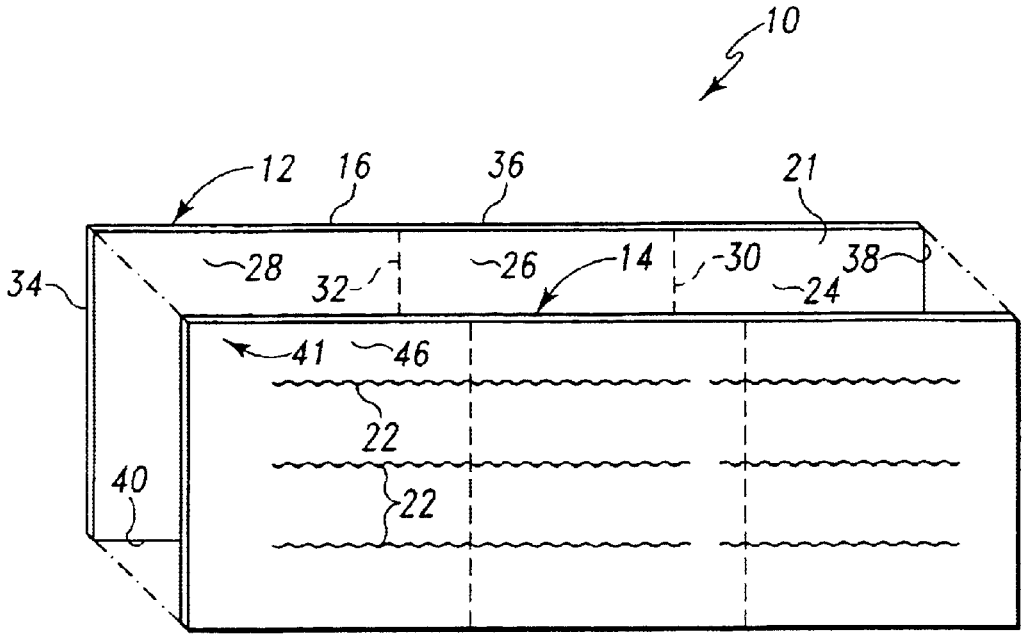
FIG. 2 is an exploded perspective view of the greeting card of FIG. 1.

A greeting card 10 has a substrate 12 and a sticker 14, such as a bumper sticker, as shown in FIGS. 1 and 2. Sticker 14 is adhesively and removably attached to substrate 12. Sticker 14 can be peeled away from substrate 12 to allow sticker 14 to be attached to another object, such as a bumper of a vehicle. Substrate 12 has information 18 printed, etched, embossed, or otherwise provided thereon for communication to a person. Sticker 14 also has information 22 printed, etched, embossed, or otherwise provided thereon for communication to a person. According to this disclosure, information 18, 22 is intended to cover all types of information presented in a visual format such as any one or more of the following: textual information, numerical information, graphical images, tabular information, pictures, and combinations thereof.

Illustrative substrate 12 comprises a single substrate layer 16 made of, for example, card stock material as shown in FIGS. 1 and 2. Information 18 is provided on a front side 19 of substrate layer 16 as shown in FIG. 1.

Layer 16 comprises three panels 24, 26, 28 and a pair of parallel creases 30, 32, as shown in FIGS. 1 and 2. Intermediate panel 26 is positioned between first and second end panels 24, 28. First crease 30 interconnects first end and intermediate panels 24, 26. Second crease 32 interconnects intermediate and second end panels 26, 28. Creases 30, 32 allow relative movement of panels 24, 26, 28 between folded and unfolded positions. Panels 24, 26, 28 provide four peripheral edges 34, 36, 38, 40 of card 10. In the illustrative embodiment, card 10 is rectangular when panels 24, 26, 28 are moved to a planar or flat configuration such that edge 34 is parallel to edge 38 and edge 36 is parallel to edge 40. It is within the scope of this disclosure for card 10 to have shapes other than rectangular, such as, for example, square, round, triangular, oval, trapezoidal, or the like, as well as all types of irregular shapes.

Sticker 14 has a substrate layer 41 and a layer 20 of adhesive material provided on a back side 42 of substrate layer 41 for removably attaching sticker 14 to a back side 44 of card stock substrate layer 16, as shown in FIG. 1. Information 22 is provided on a front side 46 of sticker substrate layer 41 as shown in FIGS. 1 and 2. Sticker 14 is attached to panels 24, 26, 28 and extends across creases 30, 32 and to edges 34, 36, 38, 40. Thus, sticker 14 folds and unfolds along with panels 24, 26, 28 when sticker 14 is attached to substrate 12. In some embodiments, back side 44 of substrate layer 16 is coated so that sticker 14 is removable from substrate 12 without inadvertently detaching portions of substrate 12 or otherwise damaging substrate 12 during the removal of sticker 14 from substrate 12.

Figure 3:
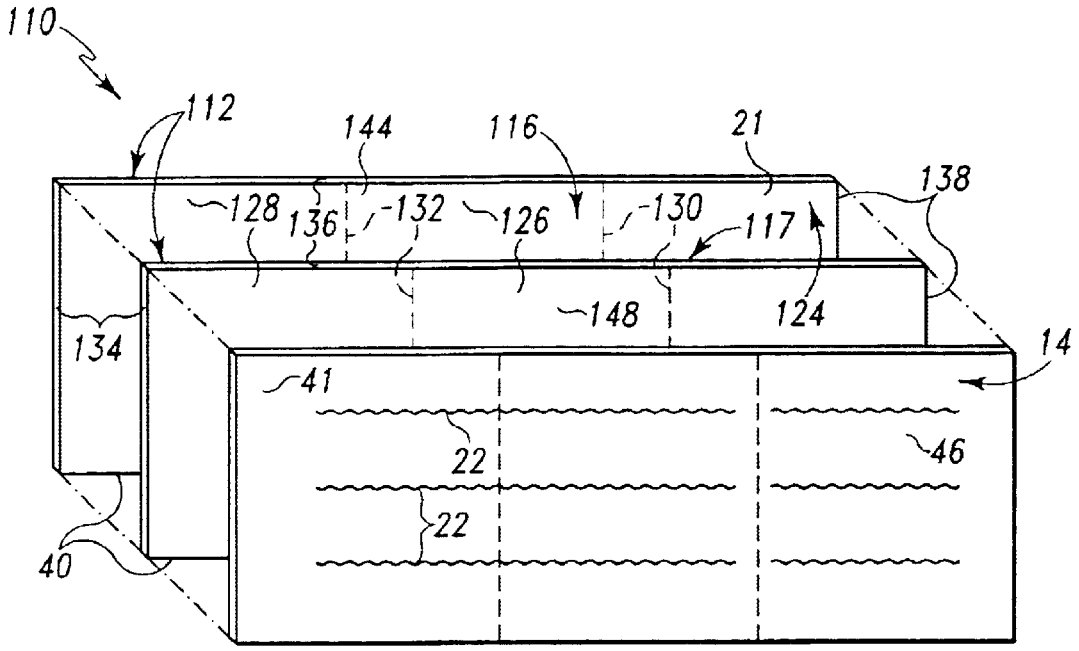
FIG. 3 is an exploded perspective view of another greeting card having a card stock substrate layer, a wax paper substrate layer, and a sticker to be adhesively and removably attached to the wax paper substrate layer, the greeting card having three panels interconnected by a pair of creases for folding the greeting card in thirds, and the sticker being configured to extend to the edges of the substrate layers.

A greeting card 110, shown in FIG. 3, is similar to greeting card 10, except as otherwise noted, so that identical reference numbers refer to similar structures. A pair of substrates 112 of apparatus 110 comprises a layer 117 of wax paper and a card stock substrate layer 116. Sticker 14 is removably attached to layer 117 such that layer 117 is sandwiched between sticker 14 and layer 116. A first side of wax paper layer 117 is attached to a back side 144 of card stock substrate layer 16 and adhesive layer 20 is removably attached to a second side 148 of wax paper layer 117.

Card stock substrate layer 116 and wax paper layer 117 cooperate to provide panels 124, 126, 128, parallel creases 130, 132, and peripheral edges 134, 136, 138, 140 of greeting card 110. Edge 134 is parallel to edge 138 and edge 136 is parallel to edge 140. Creases 130, 132 are parallel to edges 134, 138 and allow relative movement of panels 124, 126, 128 between folded and unfolded positions. Sticker 14 extends across creases 130, 132 and to edges 134, 136, 138, 140.

Information (not shown) is provided on a front side (not shown) of card stock substrate layer 116 for communication to a person. Information 122 is provided on front side 46 of sticker 14 for communication to a person.

A greeting card 210, shown in FIGS. 4*a*–4*d*, is similar to greeting card 10, except as otherwise noted, so that identical reference numbers refer to similar structures. Substrate 212 of greeting card 210 has three parallel creases 230, 232, 233 that divide card stock substrate layer 216 into four panels 224, 226, 228, 229, as shown best in FIG. 4*b*, so that greeting card 210 can be folded in fourths as suggested in FIGS. 4*a* and 4*d*. Crease 230 interconnects first end panel 224 and first intermediate panel 226. Crease 232 interconnects first intermediate panel 226 and second intermediate panel 228. Crease 234 interconnects second intermediate panel 228 and second end panel 230. Creases 230, 232, 233 allow relative movement of panels 224, 226, 228, 229 between folded (see FIG. 4*d*) and unfolded (see FIG. 4*b*) positions.

Adhesive layer 20 is removably attached to panels 224, 226, 228, 229 on back side 244 of card 212 such that sticker 14 extends across creases 230, 232, 233 to peripheral edges 234, 236, 238, 240 of greeting card 210. Edges 234, 238 are parallel. Front sides of panels 224, 226, 228, 229 cooperate to provide a front side 219 of greeting card 212. Back sides of panels 224, 226, 228, 229 cooperate to provide a back side 244 of greeting card 212.

Figure 4A:
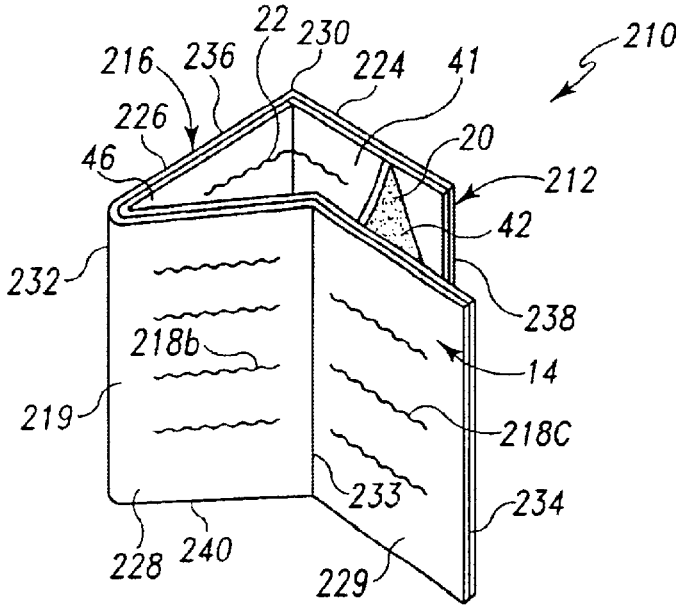
FIG. 4*a* is a perspective view of another greeting card shown partially folded, the greeting card having a substrate and a sticker adhesively and removably attached thereto, the greeting card having four panels interconnected by three creases for folding the greeting card in fourths.
Figure 4B:
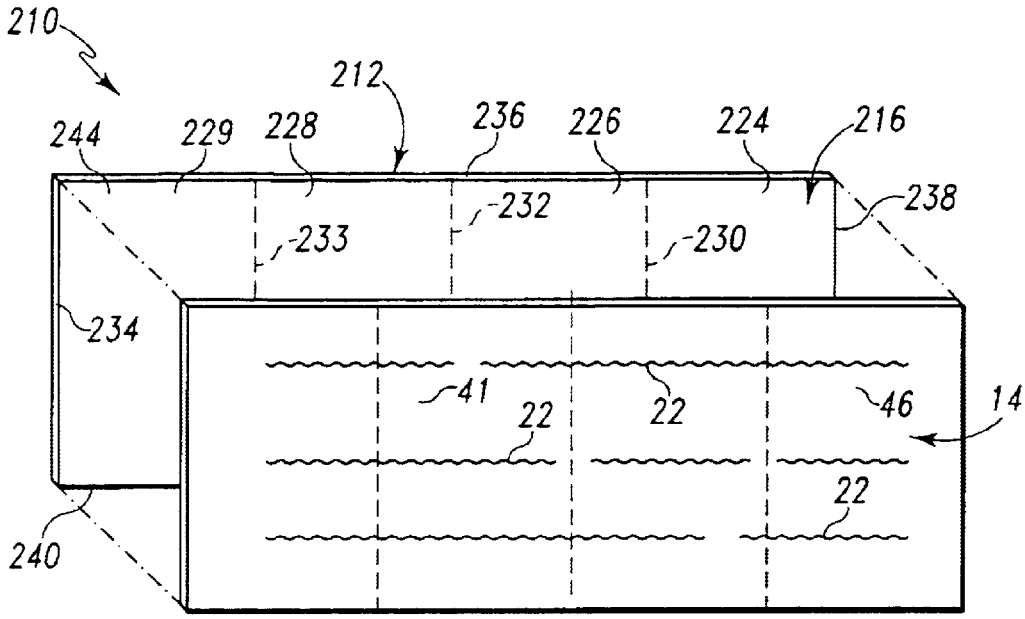
FIG. 4*b* is an exploded perspective view of the greeting card of FIG. 4*a;*
Figure 4C:
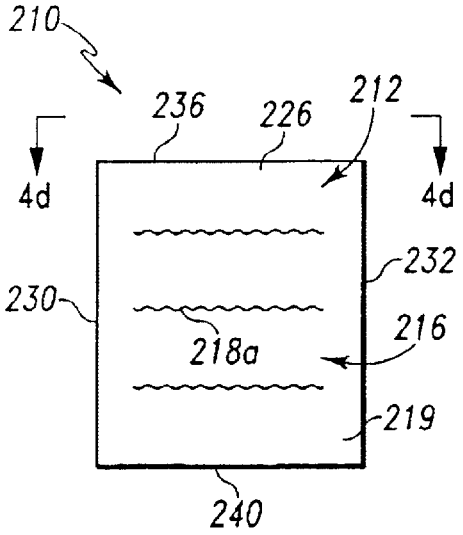
FIG. 4*c* is an elevation view of the greeting card of FIGS. 4*a* and 4*b* in a folded position.
Figure 4D:
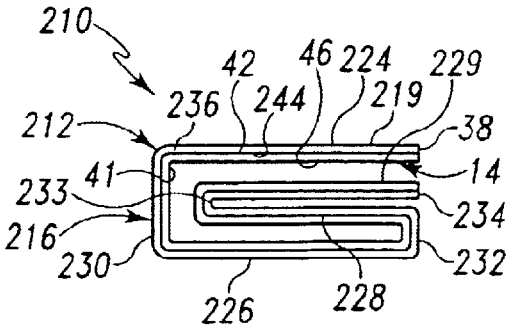
FIG. 4*d* is a top plan view taken along line 4*d*—4*d* of FIG. 4*c;*

When greeting card 210 is folded, crease 233 is nested in crease 230, the back side of first end panel 224 faces the back side of second end panel 229, and the back side of first intermediate panel 226 faces the back side of second intermediate panel 228, as shown in FIG. 4*d*. The front sides of first intermediate panel 226, second intermediate panel 228, and second end panel 229 provide first, second, and third pages, respectively, of greeting card 212 and have information 218*a* (see FIG. 4*c*), 218*b* (see FIG. 4*a*), and 218*c* (see FIG. 4*a*), respectively, for communication to a person. Thus, greeting card 210 has sticker 14 generally hidden from view until substrate 212 is unfolded substantially completely. In use, a person generally views or reads information 218*a* first and then unfolds card 210 along creases 230, 233 to expose information 218*b*, 218*c* for viewing or reading. Thereafter, the person unfolds card 210 along crease 232 to gain access to sticker 14 for removal.

Figure 5:
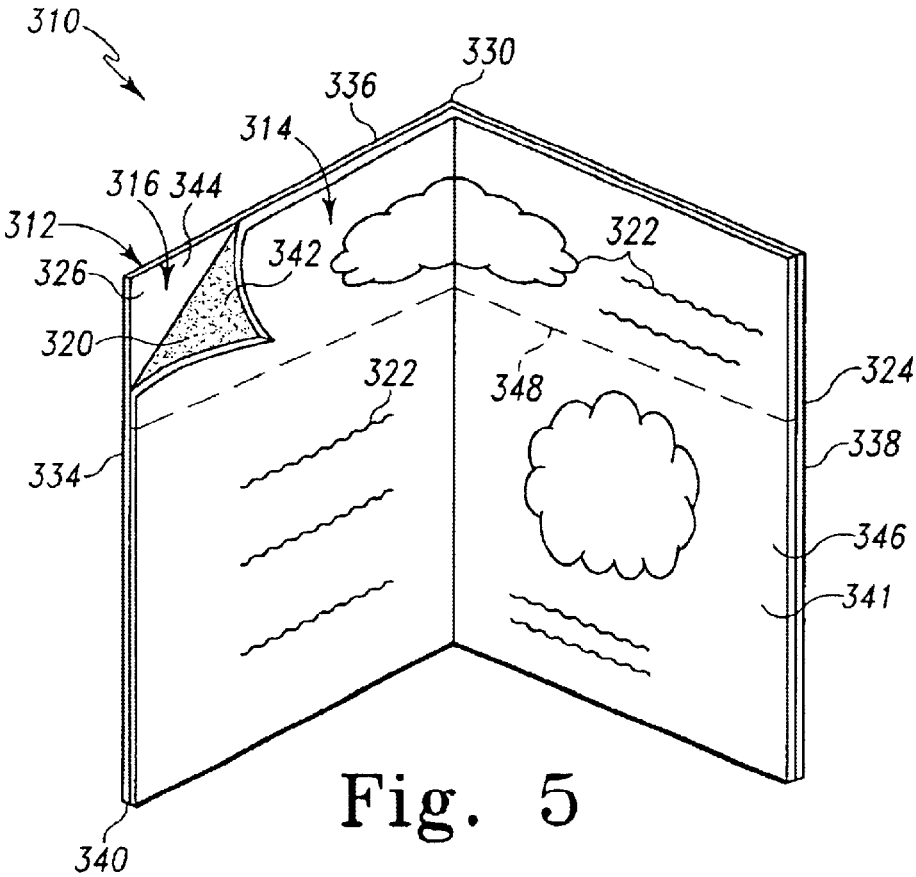
FIG. 5 is a perspective view of yet another greeting card having a first substrate and a second substrate coupled to the first substrate, an upper portion of the second substrate providing a sticker that is adhesively and removably attached to the first substrate, a lower portion of the second substrate remaining attached to the first substrate when the sticker is removed from the first substrate, and the greeting card having two panels interconnected by a crease for folding the greeting card in half.

A greeting card 310 has a substrate 312 and a sticker 314, such as a bumper sticker, as shown in FIG. 5. Sticker 314 is adhesively and removably attached to card 312. Sticker 314 can be peeled away from card 312 to allow sticker 314 to be attached to another object, such as a bumper of a vehicle. Card 312 has information (not shown) printed or otherwise provided thereon for communication to a person. Sticker 314 has information 322 printed or otherwise provide thereon for communication to a person.

Card 310 has a substrate layer 316 made of, for example, card stock material. The information on card 310 is provided on a front side (not shown) of substrate layer 316.

Substrate layer 316 has two panels 324, 326 and a crease 330 that interconnects panels 324, 326. Crease 330 allows relative movement of panels 324, 326 between folded and unfolded positions. Panels 324, 326 provide four peripheral edges 334, 336, 338, 340 of card 312. Edges 334 and 338 are parallel.

Sticker 314 has a substrate layer 341 and a layer 320 of adhesive material provided on a back side 342 of substrate layer 341 for removably attaching sticker 314 to a back side 344 of card stock substrate layer 316. Information 322 is provided on a front side 346 of sticker substrate layer 341. In some embodiments, sticker 314 is attached to panels 324, 326 and extends across crease 330 all the way to edges 334, 336, 338, 340. In other embodiments, sticker 314 only partially covers panels 324, 326, as suggested by score line 348, or is divided into two stickers which cover panels 324, 326 and meet at score line 348.

In those embodiments in which only the upper portion of substrate 341 provides the removable sticker 314, such as in the illustrative embodiment of FIG. 5, then only three of the four outer edges of sticker 314 extend to associated edges 334, 336, 338 of substrate layer 316, the fourth outer edge of sticker 314 being associated with score line 348. In the illustrative embodiment, the adhesive layer 320 associated with sticker 314 above score line 348 is of the type that permits removal of sticker 314 from substrate layer 316, whereas the adhesive layer associated with the non-sticker portion of substrate 341 below score line 348 is of the type that prevents or inhibits removal of the non-sticker portion of substrate 341 from substrate layer 316.

In alternative embodiments, a wax paper layer is bonded to substrate layer 316 only in the region above score line 348 and adhesive layer 320 is of the type that permits sticker 314 to be peeled from the wax paper layer but that inhibits peeling of the portion of substrate 341 that is adhered directly to substrate layer 216. In addition, greeting card embodiments in which the portion of substrate 341 below score line 348 provides the sticker of the greeting card 310, whereas the portion of substrate 341 above score line 348 provides the non-sticker portion of substrate 341, are within the scope of this disclosure. In such embodiments, the outer edges of the sticker extend to or are coextensive with edges 334, 338, 340 of substrate layer 316.

Figure 6:
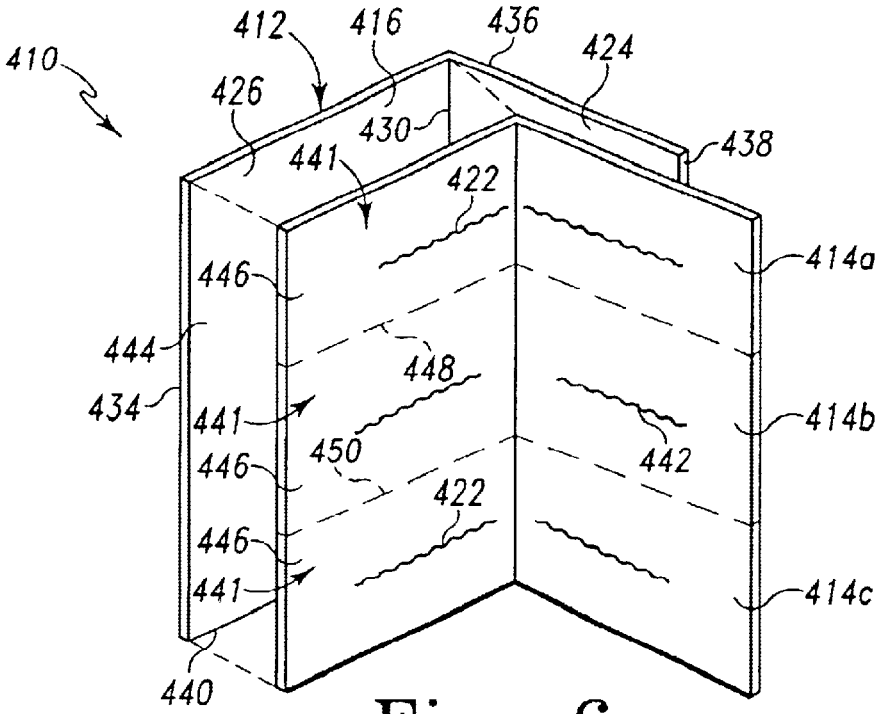
FIG. 6 is an exploded perspective view of still another greeting card having a substrate and three stickers to be adhesively and removably attached to the substrate, the greeting card having two panels interconnected by a crease for folding the greeting card in half.

A greeting card 410 has a substrate 412 and three stickers 414*a*, 414*b*, 414*c*, as shown in FIG. 6. Stickers 414*a*, 414*b*, 414*c* are adhesively and removably attached to substrate 412. Stickers 414*a*, 414*b*, 414*c* can be peeled away individually from substrate 412 to allow them to be attached to another object, such as a bumper of a vehicle. Substrate 412 has information (not shown) printed or otherwise provided thereon for communication to a person. Stickers 414*a*, 414*b*, 414*c* also have information 422 printed or otherwise provided thereon for communication to a person.

Substrate 412 has a substrate layer 416 made of, for example, card stock material. The information on substrate 412 is provided on a front side (not shown) of substrate layer 416.

Substrate layer 416 has two panels 424, 426 and a crease 430 that interconnects panels 424, 426. Crease 430 allows relative movement of panels 424, 426 between folded and unfolded positions. Panels 424, 426 provide four peripheral edges 434, 436, 438, 440 of card 412. Edges 434 and 438 are parallel.

Each sticker 414*a*, 414*b*, 414*c* has a substrate layer 441 and a layer of adhesive material (not shown) provided on a back side of its substrate layer 441 for removably attaching sticker 414*a*, 414*b*, 414*c* to a back side 444 of card stock substrate layer 416. Information 422 is provided on a front side 446 of each sticker substrate layer 441. Each sticker 414*a*, 414*b*, 414*c* is attached to panels 424, 426 and extends across crease 430 and to edges 434, 438. Stickers 414*a*, 414*b* meet at a first score line or sticker interface 448 and stickers 414*b*, 414*c* meet at a second score line or sticker interface 450 so that stickers 414*a*, 414*b*, 414*c* cooperate to extend from edge 436 to edge 440. Thus, three of the outer or peripheral edges of each of stickers 414*a*, 414*c* extend to or are coextensive with three associated outer or peripheral edges of substrate 412, whereas two to the outer edges of sticker 414*b* (i.e., the side edges of sticker 414*b*) are coextensive with two associated peripheral edges of substrate 412. This disclosure further contemplates greeting card embodiments in which only one peripheral edge of a sticker is coextensive with an associated edge of the substrate to which the sticker is removably attached.

Figure 7:
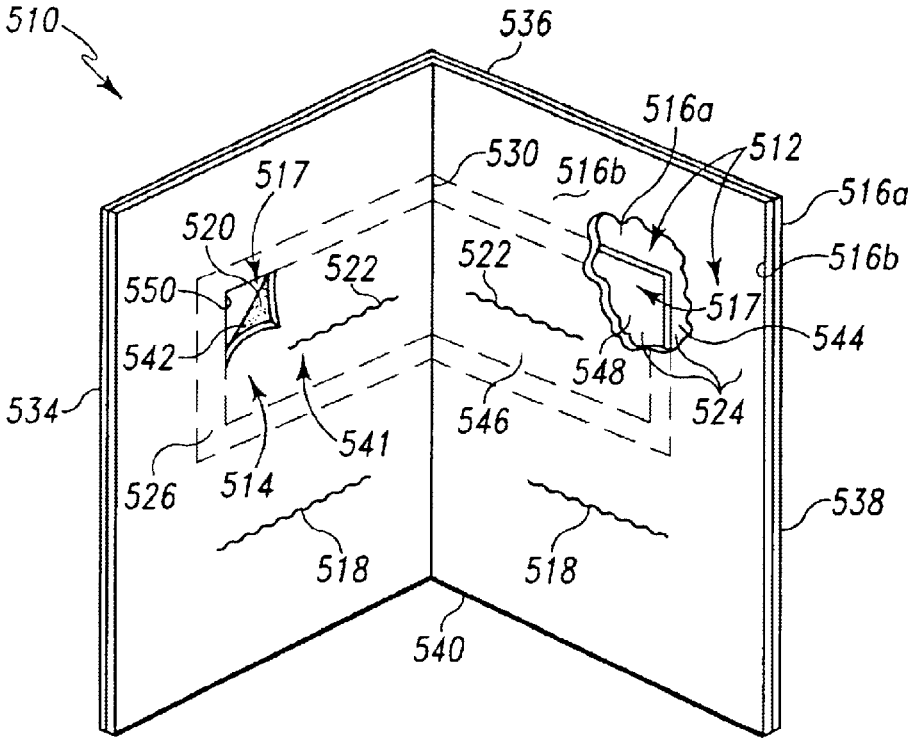
FIG. 7 is a perspective view of a further greeting card having a pair of substrates coupled together, a wax paper layer between the pair of substrates, and a portion of one of the substrates providing a sticker adhesively and removably attached to the wax paper layer, the sticker being bounded by score lines that are spaced from outer edges of the pair of substrates, and the greeting card having two panels interconnected by a crease for folding the greeting card in half.

A greeting card 510 has a substrate 512 and a sticker 514, such as a bumper sticker, as shown in FIG. 7. Sticker 514 is adhesively and removably attached to card 512. Sticker 514 can be peeled away from card 512 to allow sticker 512 to be attached to another object, such as a bumper of a vehicle. Substrate 512 has information 518 printed or otherwise provided thereon for communication to a person. Sticker 514 has information 522 printed or otherwise provided thereon for communication to a person.

Substrate 512 has a pair of substrate layers 516*a*, 516*b*, either or both of which are made of, for example, card stock material, and which are attached to one another. Substrate 512 also has a wax paper layer 517 sandwiched between card stock substrate layers 516*a*, 516*b*. Layers 516*a*, 516*b* cooperate to provide peripheral edges 534, 536, 538, 540 of substrate 512. Edges 534 and 538 are parallel. Layers 516*a*, 516*b*, 517 cooperate to provide a pair of panels 524, 526 and a crease 530 interconnecting panels 524, 526 for relative movement of panels 524, 526 between folded and unfolded positions.

Card stock substrate layer 516*b* is formed to include a window 550 defined by a set of score lines. The portion of card stock substrate layer 516*b* received in window 550 provides the sticker 514 of card 510. A first side (not shown) of wax paper layer 517 is attached to a back side 544 of layer 516*a*. An adhesive layer 520 of sticker 514 is removably attached to a second side 548 of wax paper layer 517.

Sticker 514 has a substrate layer 541. Sticker adhesive layer 520 is provided on a back side 542 of sticker substrate layer 541. Sticker information 522 is provided on a front side 546 of sticker substrate layer 641. Sticker 514 extends from panel 524 across crease 530 to panel 526 on wax paper layer 517. The outer or peripheral edges of sticker 514 and wax paper layer 517 are spaced apart from edges 534, 536, 538, 540 of substrate 512.

Figure 8:
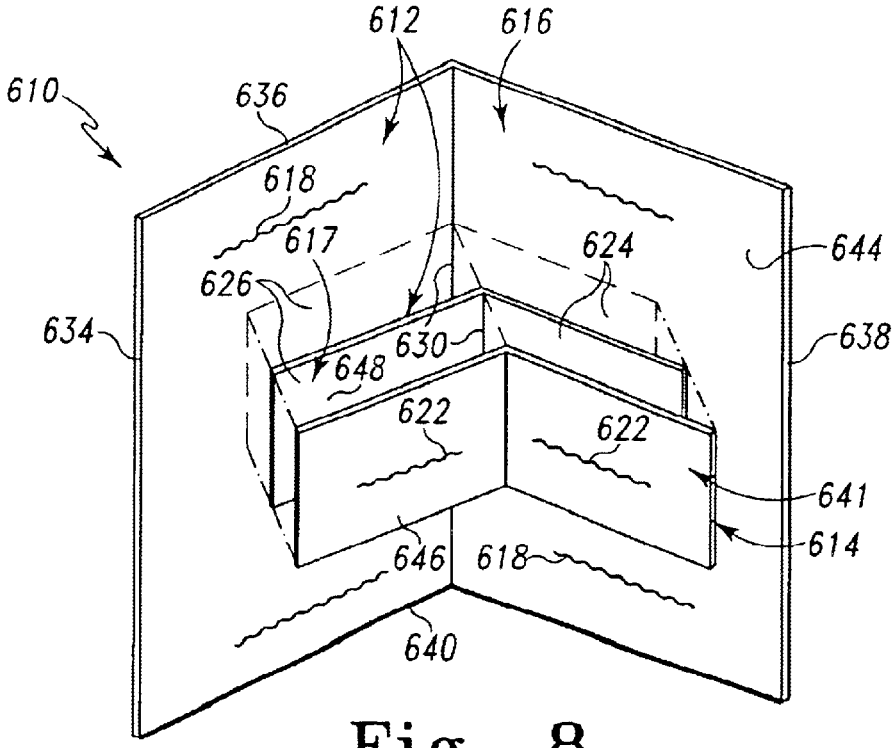
FIG. 8 is a perspective view of another greeting card having a larger card stock substrate layer, an intermediate smaller wax paper layer to be attached to the card stock substrate layer, and a sticker to be adhesively and removably attached to the wax paper layer, the greeting card having two panels interconnected by a crease for folding the greeting card in half, and the sticker having outer edges that are spaced from the outer edges of the card stock substrate layer.

A greeting card 610 has a substrate 612 and a sticker 614, such as a bumper sticker, as shown in FIG. 8. Sticker 614 is adhesively and removably attached to substrate 612. Substrate 612 has information 618 printed or otherwise provided thereon for communication to a person. Sticker 614 can be peeled away from substrate 612 to allow sticker 614 to be attached to another object, such as a bumper of a vehicle. Sticker 614 has information 622 printed or otherwise provide thereon for communication to a person.

Substrate 612 has a substrate layer 616 made of, for example, card stock material and a wax paper layer 617 between card stock substrate layer 616 and sticker 614. A first side (not shown) of wax paper layer 617 is attached to a back side 644 of layer 616 and an adhesive layer (not shown) of sticker 614 is removably attached to a second side 648 of wax paper layer 617. Information 618 is provided on one or both of a front side (not shown) of substrate layer 616 and back side 644.

Card stock substrate layer 616 and wax paper layer 617 cooperate to provide two panels 624, 626 and a crease 630 that interconnects panels 624, 626. Crease 630 allows relative movement of panels 624, 626 between folded and unfolded positions. Panels 624, 626 provide four peripheral edges 634, 636, 638, 640 of substrate 612. Edges 634 and 638 are parallel.

Sticker 614 has a substrate layer 641. The sticker adhesive layer is provided on a back side (not shown) of sticker substrate layer 641. Information 622 is provided on a front side 646 of sticker substrate layer 641. Sticker 614 extends from panel 624 across crease 630 to panel 626 on wax paper layer 617. The outer or peripheral edges of sticker 614 and of wax paper layer 617 are spaced apart from edges 634, 636, 638, 640 of substrate layer 616. In the illustrative embodiment, the outer edges of sticker 614 extend to or are coextensive with the outer edges of wax paper layer 617. In alternative embodiments, the outer edges of wax paper layer 617 are positioned between respective outer edges of sticker 614 and associated outer edges of substrate layer 616.

In each of the embodiments of greeting card disclosed herein, a sticker extends across a crease or fold of at least one substrate. In some embodiments, all of the outer peripheral edges of the sticker extend to or are coextensive with the outer peripheral edges of at least one substrate comprising the greeting card. In other embodiments, only a portion of the peripheral edges of the sticker extend to or are coextensive with one or more associated peripheral edges of at least one substrate comprising the greeting card. In still other embodiments, the outer peripheral edges of the sticker are spaced from the outer peripheral edges of at least one substrate comprising the greeting card.

Although greeting cards 10, 110 are illustrated with two creases for folding in thirds, greeting card 210 is illustrated with three creases for folding in fourths, and greeting cards 310, 410, 510, 610 are illustrated with one crease for folding in half, it is within the scope of this disclosure for greeting cards to have any number of creases. In addition, it is within the scope of this disclosure for creases to be formed in greeting cards such that panels of unequal size result. In addition, creases that are horizontal or at an angle so as to be nonvertical and nonhorizontal are contemplated by this disclosure. In each of such embodiments, a sticker is contemplated as extending across at least one of the creases. Furthermore, greeting cards having stickers "outside" of the card when folded rather than "inside" the card are contemplated by this disclosure, as are cards that are folded akin to an accordion.

The term "greeting card" as used in this disclosure, including in the claims, is intended to cover foldable substrates, such as those described herein, having information (textual, pictorial, numerical, graphical, tabular, and so on) thereon. However, substrates having information that is purely or predominantly instructional in nature, such as information printed on one or more backing layers of a sticker that describe how to remove the backing layer(s) and/or how to remove the sticker from the backing layer(s), are not within the scope of the term "greeting card" as contemplated by this disclosure.

The term "sticker" as used in this disclosure, including in the claims, is intended to cover stickers of all types and is not to be limited only to so-called bumper stickers. That is, stickers of all shapes and sizes are contemplated by this disclosure. Furthermore, this disclosure contemplates that the stickers disclosed herein, once removed from the remainder of the greeting card, may be attached to any desired object, not just bumpers of vehicles.

Although certain illustrative embodiments have been disclosed in detail, variations and modifications exist within the scope and spirit of the disclosure as described and defined in the following claims.

What is claimed is:

1. A greeting card comprising a substrate having a first crease, the substrate being folded along the first crease to assume a folded configuration, and a sticker removably attached to the greeting card, the sticker extending across the first crease when the substrate is positioned in the folded configuration.

2. The greeting card of claim 1, wherein the substrate has a second crease, and the sticker extends across the second crease.

3. The greeting card of claim 2, wherein the substrate has a third crease, and the sticker extends across the third crease.

4. The greeting card of claim 1, wherein the substrate has first and second peripheral edges parallel to the first crease, and the sticker extends from the first peripheral edge to the second peripheral edge.

5. The greeting card of claim 4, wherein the substrate has third and fourth peripheral edges perpendicular to the first crease, and the sticker extends from the third peripheral edge to the fourth peripheral edge.

6. The greeting card of claim 1, wherein the substrate has a layer of card stock and a layer of wax paper positioned on the layer of card stock and extending across the crease, and the sticker is removably attached to the layer of wax paper.

7. The greeting card of claim 1, wherein the substrate has a first layer of card stock, a second layer of card stock attached to the first layer of card stock, and a layer of wax paper positioned between the first layer of card stock and the second layer of card stock, the second layer of card stock has a window, the sticker is removably attached to the wax paper, and the sticker is positioned in the window.

8. A greeting card comprising a substrate having a first crease, a first peripheral edge, and a second peripheral edge, the first and second peripheral edges being parallel to the first crease, and a sticker removably attached to the greeting card, the sticker extending from the first peripheral edge across the first crease to the second peripheral edge.

9. The greeting card of claim 8, wherein the substrate has a front side and a back side, the front side and the sticker have information for communication to a person, and the sticker is removably attached to the back side.

10. The greeting card of claim 8, wherein the substrate has a first panel and a second panel, the first crease interconnects the first panel and the second panel, the first panel has the first peripheral edge, the second panel has the second peripheral edge, and the sticker is removably attached to the first panel and the second panel.

11. The greeting card of claim 8, wherein the substrate has a second crease parallel to the first crease, and the sticker extends across the second crease.

12. The greeting card of claim 11, wherein the substrate has a first panel, a second panel, and a third panel, the first crease interconnects the first panel and the second panel, and the second crease interconnects the second panel and the third panel, the first panel has the first peripheral edge, the third panel has the second peripheral edge, and the sticker is removably attached to the first panel, the second panel, and the third panel.

13. The greeting card of claim 11, wherein the substrate has a third crease parallel to the first and second creases, and the sticker extends across the third crease.

14. The greeting card of claim 13, wherein the substrate has a first panel, a second panel, a third panel, and a fourth panel, the first crease interconnects the first panel and the second panel, the second crease interconnects the second panel and the third panel, the third crease interconnects the third panel and the fourth panel, the first panel has the first peripheral edge, the fourth panel has the second peripheral edge, and the sticker is removably attached to the first panel, the second panel, the third panel, and the fourth panel.

15. The greeting card of claim 8, wherein the substrate is folded along the first crease to assume a folded configuration, and the sticker extends from the first peripheral edge across the first crease to the second peripheral edge when the substrate is positioned in the folded configuration.

16. A greeting card comprising a substrate having a first end panel, a second end panel, a first intermediate panel, a second intermediate panel, a first crease interconnecting the first end panel and the first intermediate panel, a second crease interconnecting the first intermediate panel and the second intermediate panel, and a third crease interconnecting the second intermediate panel and the second end panel, each of the first and second end panels and the first and second intermediate panels having a back side and a front side, the back sides of the first and second end panels facing one another, the back sides of the first and second intermediate panels facing one another, and the front sides of the second intermediate panel and the second end panel facing one another, and a sticker having an adhesive layer for removably attaching the sticker to the back sides of the first and second end panels and the first and second intermediate panels, the sticker extending across the first, second, and third creases.

17. The greeting card of claim 16, wherein the front side of each of the first intermediate panel, the second intermediate panel, and the second end panel has information for communication to a person.

18. The greeting card of claim 16, wherein the sticker includes a front side and a back side, the front side of the sticker has information for communication to a person, and the back side of the sticker has the adhesive layer.

19. The greeting card of claim 16, wherein the substrate has four peripheral edges, and the sticker extends to the four peripheral edges.

20. The greeting card of claim 19, wherein the four peripheral edges cooperate to define a closed path.

21. The greeting card of claim 16, wherein the third crease nests in the first crease when the substrate is in a folded configuration.

22. The greeting card of claim 16, wherein the adhesive layer is removable attaching the sticker to the back side of each of the first end panel, the second end panel, the first intermediate panel, and the second intermediate panel.

* * * * *